United States Patent [19]

Rasch et al.

[11] 4,284,041

[45] Aug. 18, 1981

[54] METHOD OF PRODUCING CYLINDER HEADS, AND CYLINDER HEAD PRODUCED THEREBY

[75] Inventors: Walter Rasch; Karl-Heinz Caspers; Klaus Wiebecke, all of Nuremberg; Max Albert, Nürnberg-Kornburg, all of Fed. Rep. of Germany

[73] Assignee: Maschinenfabrik Augsburg-Nürnberg Aktiengesellschaft, Nuremberg, Fed. Rep. of Germany

[21] Appl. No.: 30,898

[22] Filed: Apr. 17, 1979

[30] Foreign Application Priority Data

Apr. 19, 1978 [DE] Fed. Rep. of Germany ..... 2816989

[51] Int. Cl.[3] ..... F02F 1/24; B22D 19/02; F02B 77/02

[52] U.S. Cl. ..... 123/193 H; 123/668; 164/98; 29/156.4 WL

[58] Field of Search ..... 123/193 H, 191 A, 193 CH, 123/193 R, 668, 669; 164/98; 29/156.4 WL

[56] References Cited

U.S. PATENT DOCUMENTS

| | | | |
|---|---|---|---|
| 2,075,388 | 3/1937 | Cloud | 123/669 |
| 3,830,209 | 8/1974 | Jones et al. | 123/193 H |
| 3,921,701 | 11/1975 | Cordone | 164/98 |
| 4,167,207 | 9/1979 | Rao et al. | 123/193 H |

*Primary Examiner*—Craig R. Feinberg
*Attorney, Agent, or Firm*—Becker & Becker, Inc.

[57] ABSTRACT

A method of producing partially reinforced cylinder heads, including casting a material on a preformed workpiece with special material properties, whereby the casting material produces a mechanical and/or metallic bond with the preformed workpiece in the transition phase of the two materials, and cylinder head made according to this process.

2 Claims, 8 Drawing Figures

METHOD OF PRODUCING CYLINDER HEADS, AND CYLINDER HEAD PRODUCED THEREBY

The present invention relates to a method of producing partially reinforced cylinder heads, and cylinder heads produced thereby.

It is well known to make machinery parts, which are to meet widely different requirements, by composite casting processes. In a process of this type, for making flywheels for motor vehicles, high-strength steel is used for the gear teeth on the peripheral, outer rim, whereas cast iron, having a high friction coefficient, is poured into the center which is especially advantagesous for the friction clutch. The bonding of the two materials in the transition phase is achieved by causing a small zone to melt as the molten cast iron is poured. This bond is improved by the provision of holes which fill with the molten metal and on solidification thereof provide an additional interlocking or mechanical grip. These methods offer the advantage that the material can be adapted to meet the required properties at certain locations of a machinery part, which properties often may be completely contrary in nature. Apart from that, such a composite casting process will afford an appreciable saving of costs, because expensive, highly alloyed, materials frequently need be provided only at a few exposed locations.

The present invention has as its object the method of producing reinforced cylinder heads of internal combustion engines which, by suitable combination of dissimilar materials, are not only less expensive, but also meet all requirements with respect to creep strength depending on time, in particular in the area of the bridge between the valves.

This object and other objects and advantages of the invention will appear more clearly from the following specification in connection with the accompanying drawings, in which.

Figure 1:
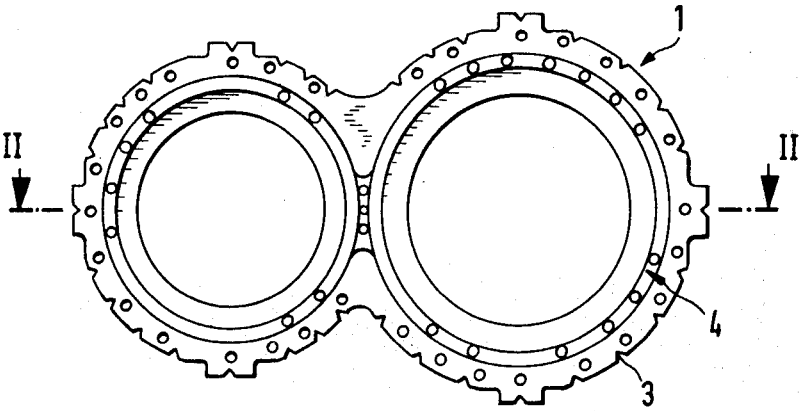
FIG. 1 is a bottom plan view of a preformed workpiece with dovetail-shaped cutouts and fusible portions, viewed from the side opposite the combustion chamber.
Figure 2:
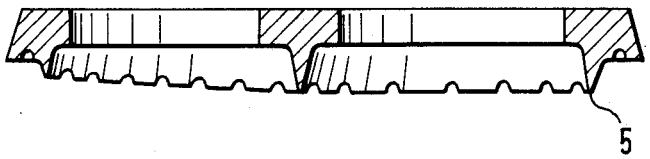
FIG. 2 is a section taken along the line II—II in FIG. 1.

The invention is primarily characterized by a method including the step of casting a material on a preformed workpiece with special material properties or of predetermined material composition, in which the cast material forms a mechanical or interlocking and/or metallic bond with the preformed workpiece in the transition phase of the two materials. The cylinder heads produced by the method are characterized by a preformed workpiece positively connected to a cast portion of the cylinder head for reinforcing those parts of the cast portion which are highly stressed during use.

In accordance with one embodiment, the preformed workpiece includes a valve web, fillet or bridge and/or valve seat embedded in molten cast iron of the type generally used for cylinder heads.

This affords absorption of the very high stresses, occurring in the bridge area between the valves, due to thermal stresses, the high pressure of the combustion gases, and also due to the stresses arising when shrink-fitting the valve rings and tightening the cylinder head bolts, by the material specifically adapted for this absorption purpose.

In accordance with another embodiment according to the invention, the alloy or composition of the preformed workpiece is made up in percentages by weight of 3.0% C maximum, 1.7 to 2.2% Si, 1.0 to 1.5% Mn, 18 to 22% Ni, 1.8 to 2.4% Cr, 0.1% Nb, 0.05% Mg, the balance being Fe; and the composition of the surrounding material is of that cast iron composition which is generally used for the cylinder heads of internal combustion engines.

These measures make it possible to substantially increase the creep strength depending on time so as to reduce the possibility of valve bridge cracks, because a high-alloy, fatigue-resistant material is used in the area of maximum thermal and mechanical stresses. The balance of the material consists of cast iron, such as is customary for cylinder heads. This provides a most favorable effect on the costs of making cylinder heads. Due to the alloying constituents of the preformed workpiece, an austenitic structure is obtained in which graphite spherulites are embedded. Such a structure not only enhances thermal fatigue strength, but also oxidation resistance and growth-stability in this highly thermally stressed region.

A further advantageous embodiment of the invention provides that the mechanical bond is improved by dovetail-shaped portions in the transition zone of the preformed workpiece and that simultaneously a metallic bond is obtained by fusible portions or sections adapted to melt in the process.

The dovetail-like cutouts on the outer perimeter of the preformed workpiece increase the surface area on which the bonding of the molten cast iron of the surrounding cylinder head occurs. This has a positive effect on the stresses which the bond can be expected to withstand. Furthermore, a metallic bond is superimposed on the mechanical bond which offers added assurance that the preformed workpiece will not break out of the remaining part of the cylinder head. The metallic bond is produced by melting of thin, fusible sections, which extend into the molten cast iron, heated to 1430° to 1500° C. A method of this type is especially advantageous when applied to cylinder heads of large bulk where sufficient heat capacity is available to cause said fusible sections to melt.

According to another feature of the invention, the mechanical bond is improved by a flaring or conical extension of the preformed workpiece at the side opposite the combustion chamber and that simultaneously a metallic bond is achieved by fusible sections or portions of the preformed workpiece.

Such an insert can particularly advantageously be applied to low bulk cylinder heads, in which a limited heat capacity of the molten cast iron is available, when compared with the preformed workpiece. In view of the small bulk of the inserts, the heat stored in the molten iron is sufficient to liquify the fusible sections. In addition to the metallic bond provided by the fusible portion or sections, a positive mechanical bond is obtained after embedding the preformed workpiece in the cylinder head, due to the flared or conically shaped portions which dependably prevent the workpiece from separating from the cylinder head.

According to a further advantageous embodiment of the method according to the invention, the pouring or casting of metal is carried out in such a manner that the casting metal rises to the preformed workpiece and that during pouring or casting, the preformed workpiece is maintained in a predetermined position by locators and core supports.

The advantage of such a method resides in excellent transmission of heat from the molten cast iron to the preformed workpiece positioned in the stream of the cast metal. The laterally projecting fusible portions or sections are immediately surrounded by the casting metal, from beginning of pouring, and are readily melted and, consequently, form an intimate metallic bond between the cylinder head and the workpiece. Due to the locators and core supports, the preformed workpiece is maintained in the predetermined position, while casting or pouring is carried out. This is absolutely necessary to ensure production continuity and reliability.

Figure 3:
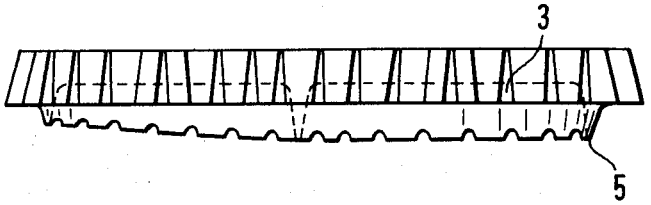
FIG. 3 is a side view of the preformed workpiece of FIG. 1.
Figure 4:
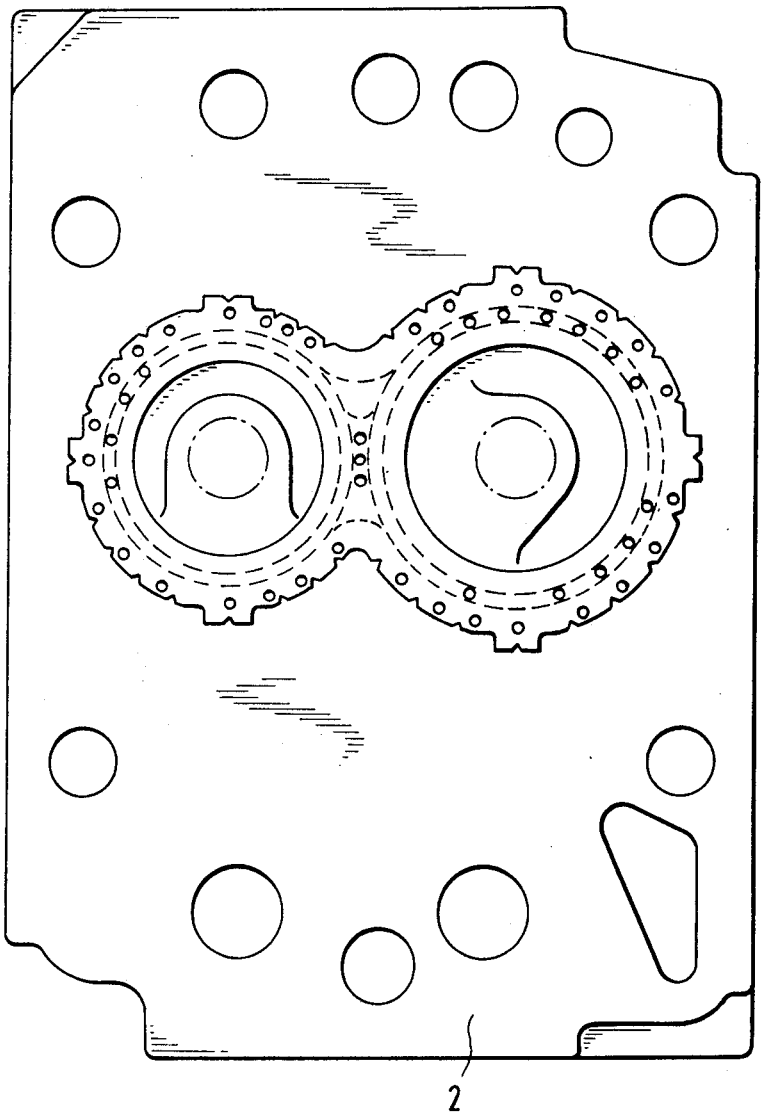
FIG. 4 shows the location of the workpiece embedded in the cylinder head according to FIGS. 1 to 3.
Figure 5:
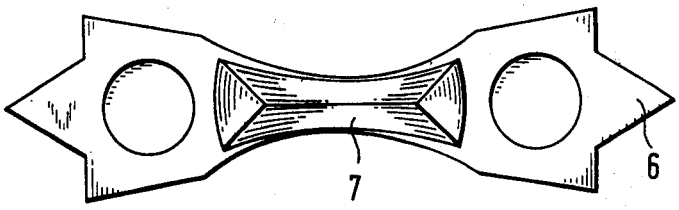
FIG. 5 is a bottom plan view of a preformed workpiece of low bulk with fusible portions viewed from the side opposite the combustion chamber.
Figure 6:
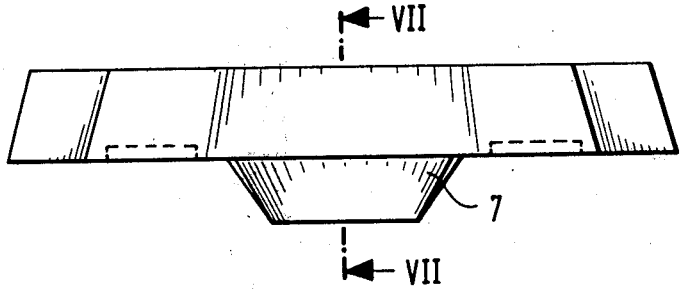
FIG. 6 is a side view of the preformed workpiece according to FIG. 5.

Referring now particularly to the drawings, FIGS. 1 and 3 show a typical embodiment of a preformed workpiece 1 for casting-embedding at the location of the valve bridge of a large bulk cylinder head 2 (FIG. 4). The figure-eight-shaped workpiece is on its outer perimeter provided with dovetail-shaped grooves or V-shaped indentations 3, which are filled with molten casting metal and, upon solidification thereof, a mechanical bond is formed. At that side of the preformed workpiece which is opposite to the combustion chamber, there is provided a fusible section 4 which extends around the whole workpiece in the form of a ridge 5. When the molten cast iron, heated to 1430° to 1500° C., is poured, the ridge 5 will melt, and a metallic bond will result between the workpiece 1 and the surrounding cast metal. The figure-eight configuration illustrated in FIGS. 1 to 4 is therefore advantageously applied to cylinder heads of large bulk, because these are capable of providing a sufficient amount of stored heat in the molten cast iron, to ensure melting of the ridge 5 of fusible section 4 with reasonable dependability.

Figure 7:
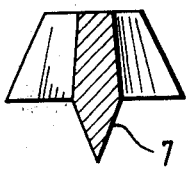
FIG. 7 is a section taken along the line VII—VII in FIG. 6.
Figure 8:
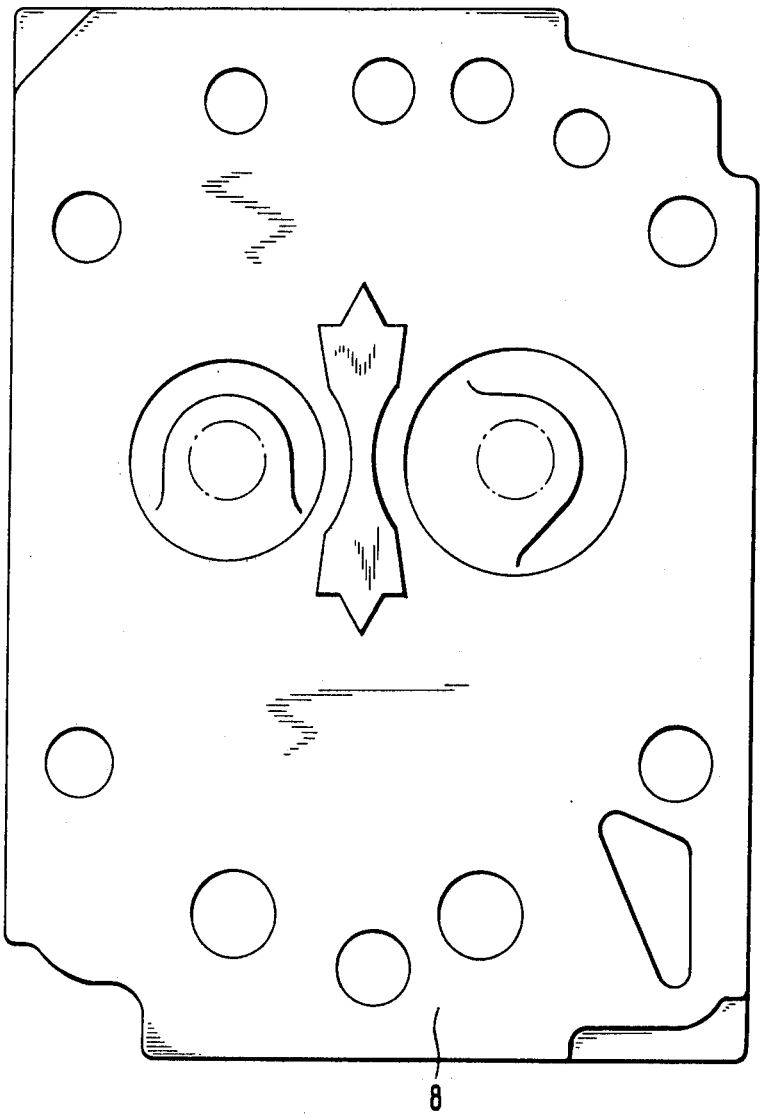
FIG. 8 shows the location of the workpiece embedded in the cylinder head according to FIGS. 5 to 7.

For cylinder heads of lower bulk, where there is not so much stored heat in the molten metal, a workpiece such as is shown in FIGS. 5 to 8, can be used. This workpiece is of substantially lower bulk and, consequently, has a lower thermal inertia. The casting metal according to this embodiment is also sufficient to melt the fusible sections 6,7, and thereby to produce a metallic bond. Due to the fact that the workpiece, as can particularly be seen in FIG. 7, is conical or flares out, starting from the combustion chamber side over its full perimeter, there is also a mechanical or interlocking bond provided in the surrounding casting metal. The location of the workpiece according to FIG. 5 in the cylinder head 8, in the cast-in state, is indicated in FIG. 8.

The invention provides the advantage that the pertaining materials can be matched to the different stress conditions, to which certain parts of the cylinder head are exposed, due to pressure and thermal loading. With a single material, it is not possible to meet often contrary requirements, such as density or impermeability, machineability, castability, tensile strength, notch impact toughness, thermal fatigue strength, and damping. For the reasons cited, the results of conventional casting processes for cylinder heads has provided only an unsatisfactory compromise. However, application of composite casting to cylinder heads has made it possible to cope with the different stress conditions, due to external boundary conditions by selecting a compatible material.

The present invention is, of course, in no way restricted to the specific disclosure of the specification and drawings, but also encompasses any modifications within the scope of the appended claims.

What we claim is:

1. A method of producing partially reinforced cylinder heads, particularly of internal combustion engines, comprising in combination the steps of:

providing a pre-formed workpiece including a valve bridge, valve seat, valve fillet, valve web and made of a predetermined material composition; and casting on said workpiece a high-alloy fatigue-resistant material for high heat stability capable of producing a bond with said predetermined material composition in areas of maximum thermal and mechanical stresses for forming a positive connection between said workpiece and said casting of high-alloy fatigue-resistant material to reduce possibility of valve bridge cracks by increasing creep strength, said pre-formed workpiece including at least one fusible portion, said method further including the steps of:

alloying said predetermined material composition of said preformed workpiece in a composition including by weight percent,

| | | |
|---|---|---|
| C | 3.0 | maximum |
| Si | 1.7–2.2 | |
| Mn | 1.0–1.5 | |
| Ni | 18–22 | |
| Cr | 1.8–2.4 | |
| Nb | 0.1 | |
| Mg | 0.05 | |
| Fe | Balance | |

and wherein said casting material includes a cast iron composition for cylinder heads of internal combustion engines, supporting said pre-formed workpiece in a predetermined position, whereby said at least one fusible portion faces downwardly; and casting said material in such a way that said casting material rises at said at least one fusible portion.

2. A method in combination according to claim 1 wherein there are additional steps including:

improving of the positive connection of the workpiece and the casting of high-alloy material by providing of at least one fusible portion and an expanded portion therewith; and simultaneously effecting the positive connection with the fusible position by material fusion connection therewith.

* * * * *